US006320545B1

(12) United States Patent
Nagumo et al.

(10) Patent No.: US 6,320,545 B1
(45) Date of Patent: Nov. 20, 2001

(54) SURFACE-MOUNT ANTENNA AND COMMUNICATION APPARATUS USING THE SAME

(75) Inventors: Shoji Nagumo, Kawasaki; Nobuhito Tsubaki, Shiga-ken; Kazunari Kawahata, Machida, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/593,072

(22) Filed: Jun. 13, 2000

(30) Foreign Application Priority Data

Jun. 24, 1999 (JP) ..... 11-177961
Apr. 13, 2000 (JP) ..... 2000-111820

(51) Int. Cl.[7] ..... H01Q 1/24; H01Q 1/38

(52) U.S. Cl. ..... 343/700 MS; 343/702; 343/895

(58) Field of Search ..... 343/700 MS, 702, 343/895, 873; H01Q 1/24, 1/38

(56) References Cited

U.S. PATENT DOCUMENTS 5,903,240 * 5/1999 Kawahata et al. ..... 343/700 MS
5,966,097 * 10/1999 Fukasawa et al. ..... 343/700 MS
6,124,831 * 9/2000 Rutkowski et al. ..... 343/700 MS

* cited by examiner

*Primary Examiner*—Hoanganh Le
(74) *Attorney, Agent, or Firm*—Ostrolenk, Faber, Gerb & Soffen, LLP

(57) ABSTRACT

A surface-mount antenna includes a dielectric substrate having a rectangular parallelepiped shape and a radiation electrode having a meandering pattern disposed on the surface of the dielectric substrate. The radiation electrode includes at least two meandering electrode units formed with different meander pitches, the at least two meandering electrode units being connected in series, and the radiation electrode being formed over at least two faces among a front face, a major surface, and a end surface of the dielectric substrate. With the above-described construction, the radiation electrode is allowed to transmit and receive electromagnetic waves in at least two different frequency bands.

7 Claims, 10 Drawing Sheets

SURFACE-MOUNT ANTENNA AND COMMUNICATION APPARATUS USING THE SAME

BACKGROUND OF THE INVENTION

1. Field of the Invention

The present invention relates to a surface-mount antenna incorporated in a communication apparatus, such as a portable telephone, and relates a communication apparatus using the surface-mount antenna.

2. Description of the Related Art

FIG. 16 shows one example of a surface-mount antenna incorporated in a communication apparatus, such as a portable telephone. A surface-mount antenna 1 includes a dielectric substrate 2 in which a radiation electrode 3, a ground electrode 4, and a feed electrode 5 are formed on the surface thereof. The radiation electrode 3 is formed over side surfaces 2*a*, 2*b* and 2*c* of the dielectric substrate 2. The ground electrode 4 is formed on the entirety of a side surface 2*d* of the dielectric substrate 2 so as to establish electrical connection with the radiation electrode 3. The feed electrode 5 is formed on the side surface 2*a* so that a predetermined distance is maintained between the feed electrode 5 and the radiation electrode 3.

The feed electrode 5 is connected to a power supply 6. When the power is supplied from the power supply 6 to the feed electrode 5, the radiation electrode 3 is supplied with the power by means of capacitive coupling from the feed electrode 5. When the supplied power drives the radiation electrode 3, the surface-mount antenna 1 transmits or receives electromagnetic waves in a single predetermined frequency band.

A 900 MHz band and a 1.9 GHz band are currently used as operating frequencies for portable telephones.

When the communication apparatus is required to use two different operating frequency bands such as these, a single surface-mount antenna must transmit and receive the electromagnetic waves in the two different frequency bands. However, the surface-mount antenna 1 in FIG. 16 can transmit or receive the electromagnetic waves only in a single frequency band.

SUMMARY OF THE INVENTION

To overcome the above described problems, preferred embodiments of the present invention provide a surface-mount antenna capable of transmitting and receiving electromagnetic waves in more than one frequency band, and a communication apparatus using this surface-mount antenna.

One preferred embodiment of the present invention provides a surface-mount antenna, comprising: a dielectric substrate in a rectangular parallelepiped shape and including a first major surface, a second major surface, a first side surface, a second side surface, a first end surface and a second end surface; a radiation electrode having a meandering pattern disposed on at least two surfaces among the first major surface, the first side surface and the second side surface of the dielectric substrate and comprising at least a first meandering electrode unit and a second meandering electrode unit being connected in series; and the first meandering electrode unit having first meander pitches and the second meandering electrode unit having second meander pitches which are narrower than the first pitches; whereby the radiation electrode is allowed to transmit and receive electromagnetic waves in at least two different frequency bands.

Since the meandering radiation electrode is disposed in which at least two meandering electrode units having different meander pitches are connected in series, the radiation electrode has a plurality of resonant frequencies that correspond to the at least two meandering electrode units. Therefore, the surface-mount antenna can transmit and receive electromagnetic waves in at least two different frequency bands.

The above described surface-mount antenna may further comprise at least one passive radiation electrode disposed on the surface of said dielectric substrate and electromagnetically coupled with the radiation electrode, whereby the at least one passive radiation electrode causes dual resonance to occur in at least one frequency band among said at least two different frequency bands of the surface-mount antenna.

When a desired bandwidth of a frequency band cannot be obtained merely by driving the radiation electrode, the passive radiation electrode causes dual resonance in the frequency band to occur, whereby the bandwidth of the frequency band can be expanded to the desired bandwidth. Therefore, the bandwidth of the surface-mount antenna can be broadened.

In the above described surface-mount antenna, the at least one passive radiation electrode may have a meandering pattern.

In the above described surface-mount antenna, the at least one passive radiation electrode may be disposed on at least two faces among the first major surface, the first side surface and the second side surface of the dielectric substrate.

Since the radiation electrode or the passive radiation electrode is disposed on more than a single surface of the rectangular parallelepiped dielectric substrate, a larger disposed area thereof can be obtained compared to a case in which the radiation electrode or the passive radiation electrode is disposed on a single surface of the dielectric substrate. Regardless of the size of the radiation electrode or the passive radiation electrode, miniaturization of the dielectric substrate can be achieved.

In the above described surface-mount antenna, the at least one passive radiation electrode may be disposed on at least the first major surface of the dielectric substrate, the disposed position thereof being different from the disposed position of the radiation electrode; and the meandering pattern of the at least one passive radiation electrode is substantially perpendicular to that of the radiation electrode.

Since the meandering pattern of the passive radiation electrode and that of the radiation electrode are disposed so as to be substantially perpendicular to each other, an interference problem in that the driving of the radiation electrode adversely affects the driving of the passive radiation electrode can be avoided. In particular, when the unconnected end of the passive radiation electrode and the ground are indirectly coupled due to capacitive coupling, this capacitive coupling can more positively prevent the above-described interference problem. The driving of the radiation electrode and the driving of the passive radiation electrode can be independently performed and lead to dual resonance in a predetermined frequency band. Accordingly, the deterioration of antenna characteristics due to the above-described interference between the radiation electrode and the passive radiation electrode can be prevented.

The above described surface-mount antenna may further comprise a matching circuit in association with the dielectric substrate, and the radiation electrode is coupled with a power supply via the matching circuit.

When the matching circuit is provided in the dielectric substrate, there is no need to form the matching circuit on a circuit substrate that is to be provided with the surface-mount antenna. Accordingly, since the implementation area of the parts of the circuit substrate as well as the number of the parts can be reduced, the cost of the parts and the cost of the implementation can be reduced.

Another preferred embodiment of the present invention provides a surface-mount antenna for transmitting and receiving electromagnetic waves in at least two different frequency bands, the surface-mount antenna comprising means for broadening the bandwidth thereof by causing dual resonance to occur in at least one of the at least two different frequency bands.

Yet another preferred embodiment of the present invention provides a communication apparatus having the above described surface-mount antenna mounted on a circuit substrate.

In the communication apparatus that uses the surface-mount antenna according to the present invention, since a plurality of frequency bands can be covered using a single surface-mount antenna, the communication apparatus can be miniaturized.

DESCRIPTION OF THE PREFERRED EMBODIMENTS

Figure 1A:
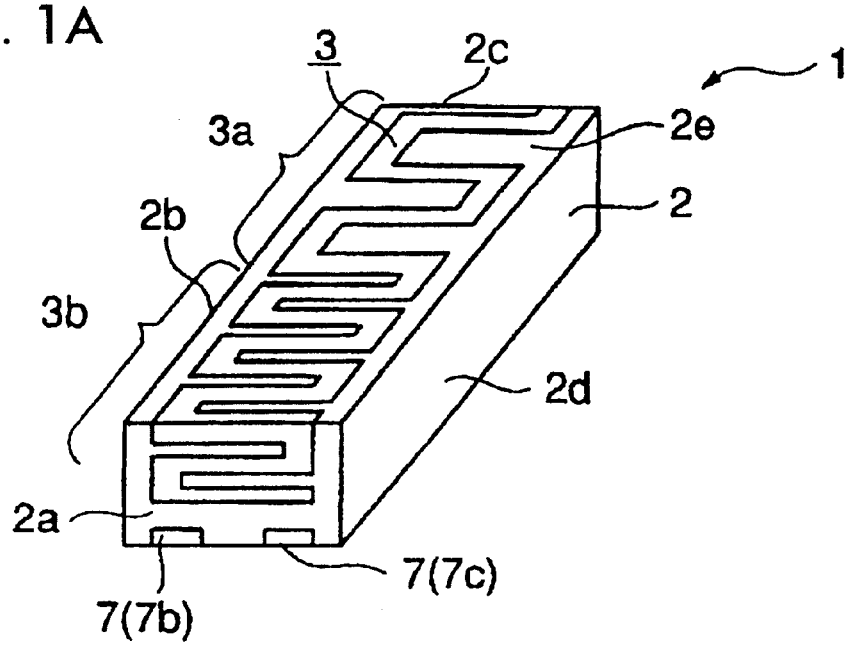
FIGS. 1A and 1B are illustrations of the surface-mount antenna according to a first embodiment of the present invention.
Figure 1B:
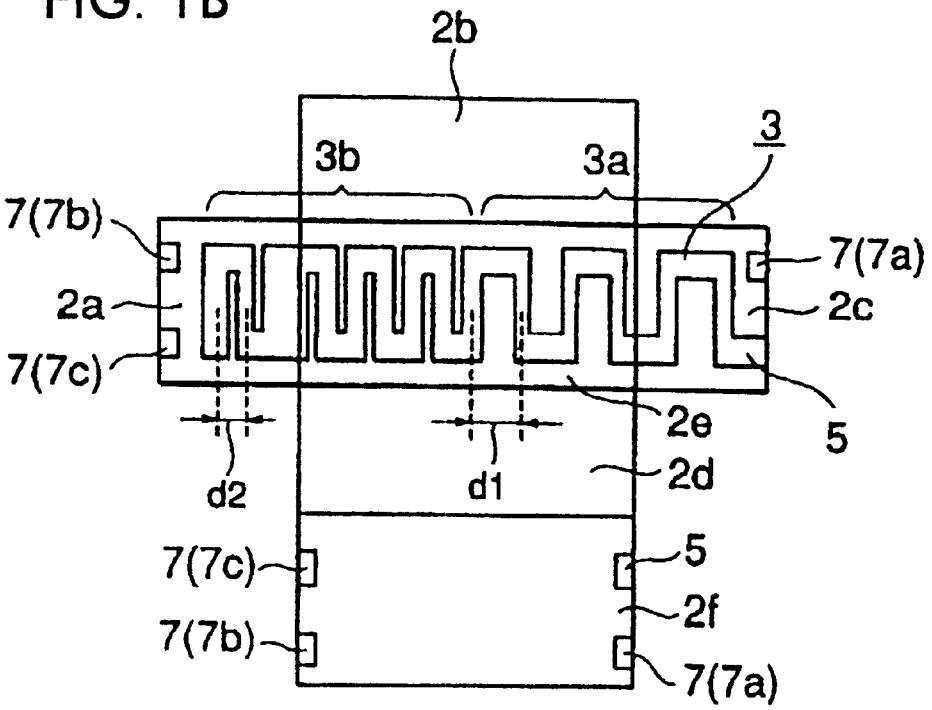

FIG. 1A shows a perspective view of a surface-mount antenna according to a first embodiment of the present invention, and FIG. 1B shows, in an expanded state, the surfaces of a dielectric substrate 2 which forms a surface-mount antenna 1 in FIG. 1A.

As shown in FIGS. 1A and 1B, the surface-mount antenna 1 includes the dielectric substrate 2 in which a meandering radiation electrode 3 is formed over a front face 2*a,* a major surface 2*e,* and a end surface 2*c* thereof.

The meandering radiation electrode 3 is constructed in which a first electrode unit 3*a* and a second electrode 3*b* that have different meandering pitches are connected in series. A meander pitch d1 (a first meander pitch) of the first electrode unit 3*a* is wider than a meander pitch d2 (a second meander pitch) of the second electrode unit 3*b.*

Figure 2:
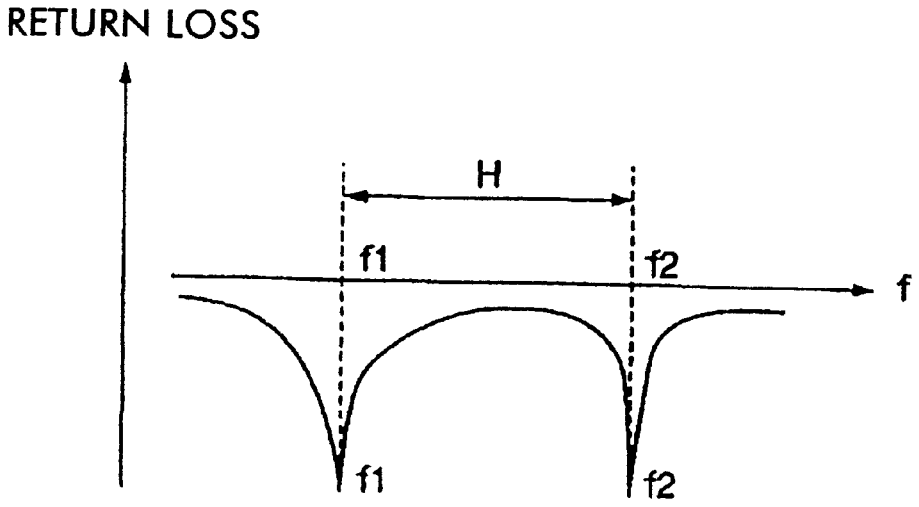
FIG. 2 is a graph illustrating one example of frequency bands in which the surface-mount antenna in FIG. 1 can transmit and receive electromagnetic waves.

The first meander pitch d1, the number of turns of the first electrode unit 3*a,* the second meander pitch d2, and the number of turns of the second electrode unit 3*b* are determined as follows. As an example, there is shown a case in which the surface-mount antenna 1 is required to have low return-losses in a first band at frequency f1 (for example, the 900 MHz band) and a second band at frequency f2 (for example, the 1.9 GHz band), as shown in FIG. 2. In other words, the surface-mount antenna 1 is required to transmit and receive electromagnetic waves in the bands at frequencies f1 and f2. In this case, the meander pitch d2 and the number of turns of the second electrode unit 3*b* are determined so that the second electrode unit 3*b,* which has the narrower meander pitch d2, can have the resonant frequency f2 shown in FIG. 2.

There is a correlation between the ratio of the first meander pitch d1 to the second meander pitch d2, and a frequency difference H between the frequencies f1 and f2 shown in FIG. 2, which can be pre-calculated. Accordingly, the first meander pitch d1 of the first electrode unit 3*a* is determined based on the above-described correlation and the second meander pitch d2. The number of turns of the first electrode unit 3*a* is determined so that resonance can occur at the resonant frequency f1 in the first electrode unit 3*a* as well as in the second electrode unit 3*b.*

As shown in FIG. 1B, a feed electrode 5 is formed on the end surface 2*c* of the dielectric substrate 2 so as to establish electrical connection with the first electrode unit 3*a* of the radiation electrode 3. A fixed electrode 7*a* is formed on the end surface 2*c* of the dielectric substrate 2. The location of the fixed electrode 7*a* is different from those of the radiation electrode 3 and the feed electrode 5.

Fixed electrodes 7*b* and 7*c* are formed on the front face 2*a* so as to face an open end of the radiation electrode 3. The feed electrode 5 and the fixed electrodes 7*a,* 7*b,* and 7*c* are each formed so as to cover parts of a bottom face 2*f* of the dielectric substrate 2.

Figure 3:
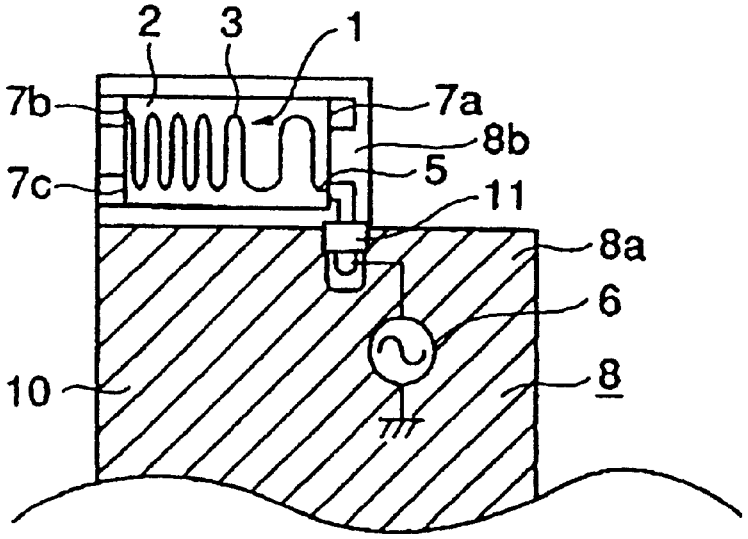
FIG. 3 is one implementation example of a circuit substrate provided with the surface-mount antenna according to the first embodiment.

The surface-mount antenna 1 according to the first embodiment is formed with the above-described construction, and, for example as shown in FIG. 3, it is mounted on a circuit substrate 8 of a communication apparatus. The circuit substrate 8 is constructed using a printed-circuit board (PCB) or the like, and includes a main unit 8*a* having a ground electrode 10 formed on the surface thereof and a non-ground unit 8*b* having no ground electrode formed on the surface thereof. In FIG. 3, the surface-mount antenna 1 is mounted on the non-ground unit 8*b.*

The circuit substrate 8 includes a power supply 6 and a matching circuit 11 that drive the surface-mount antenna 1. When the surface-mount antenna 1 is surface-mounted at a predetermined position of the non-ground unit 8*b*, the feed electrode 5 and the power supply 6 establish electrical connection via the matching circuit 11. Electrical power is supplied from the power supply 6 to the radiation electrode 3 via the matching circuit 11 and the feed electrode 5 in turn. When the first electrode unit 3*a* and the second electrode unit 3*b* of the radiation electrode 3 are driven in accordance with the supplied power, the surface-mount antenna 1 is ready for transmitting and receiving electromagnetic waves in the first band at frequency f1. When only the second electrode unit 3*b* is driven in accordance with the supplied power, the surface-mount antenna 1 is ready for transmitting and receiving electromagnetic waves in the second band at frequency f2.

According to the first embodiment, since the radiation electrode 3 is constructed in which the first electrode unit 3*a* and the second electrode unit 3*b* having different meander pitches are connected in series, the radiation electrode 3 can have two different resonant frequencies. Accordingly, the surface-mount antenna 1 can transmit and receive electromagnetic waves in the two different frequency bands.

Furthermore, since the radiation electrode 3 is formed over more than a single face of the dielectric substrate 2, a larger formation area of the radiation electrode 3 can be obtained compared to a case in which the radiation electrode 3 is formed on a single face of the dielectric substrate 2. Because of this, to some extent, freedom of design of the surface-mount antenna 1 is not limited by the length of the dielectric electrode 3, and miniaturization of the dielectric substrate 2 can be achieved. In FIGS. 1A and 1B, the second electrode unit 3*b* that has the narrower meander pitch d2 is formed over two faces of the dielectric substrate 2. However, the second electrode unit 3*b* may be confined within a single face (here, 2*a*) of the dielectric substrate 2. When the second electrode unit 3*b* is formed so as to be confined within the single face, the resonant frequencies f1 and f2 can be easily controlled.

A surface-mount antenna according to a second embodiment of the present invention is described. Elements that are identical to corresponding elements in the first embodiment have the same reference numerals, and a repeated description of identical elements is omitted.

As described in the first embodiment, the surface-mount antenna 1 includes the radiation electrode 3 having the two electrode units 3*a* and 3*b* that have different meander pitches. Accordingly, the surface-mount antenna 1 can transmit and receive electromagnetic waves in the two different bands at frequencies f1 and f2. However, there are cases in which the bandwidth of one of the bands at frequencies f1 and f2 is shorter than the desired bandwidth.

Figure 4:
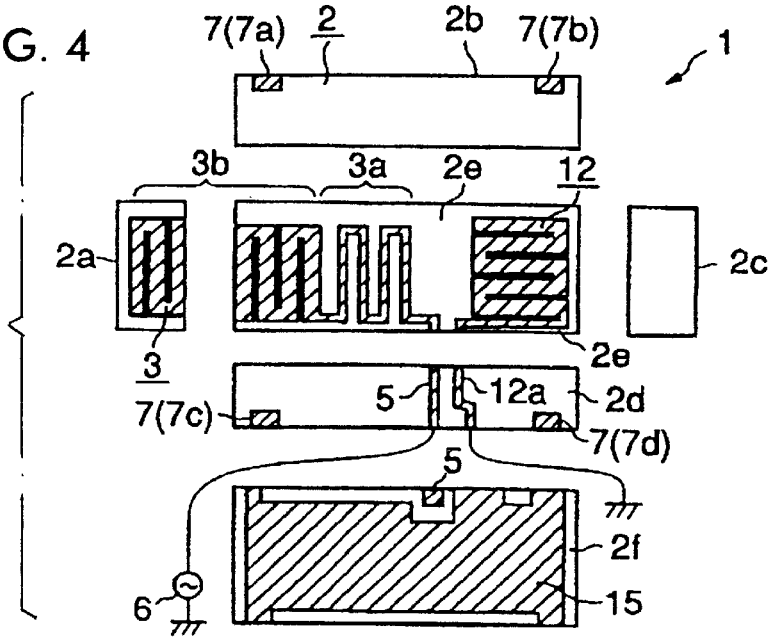
FIG. 4 is an illustration of a surface-mount antenna according to a second embodiment of the present invention.

In the second embodiment, in order to expand such a bandwidth to the desired bandwidth, the following construction is provided. FIG. 4 shows, in an expanded state, the surfaces of the dielectric substrate 2 which forms the surface-mount antenna 1 according to the second embodiment. A characteristic feature of the surface-mount antenna 1 according to the second embodiment is that a passive radiation electrode 12, as shown in FIG. 4, is formed on the dielectric substrate 2. The passive radiation electrode 12 is formed to have a meandering shape on the major surface 2*e* so as to go from the side surface 2*d* toward the side surface 2*b*. A lead-in pattern 12*a* is formed over the bottom face 2*f* and the side surface 2*d*. One end of the meandering passive radiation electrode 12 is connected to the lead-in pattern 12*a* and the other end thereof is unconnected.

Figure 5A:
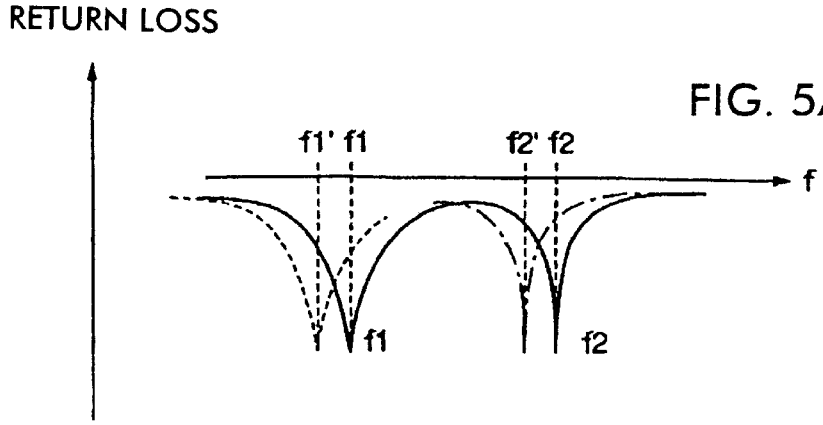
FIGS. 5A and 5B are graphs illustrating examples of frequency bands in which the surface-mount antenna in FIG. 4 can transmit and receive electromagnetic waves.
Figure 5B:
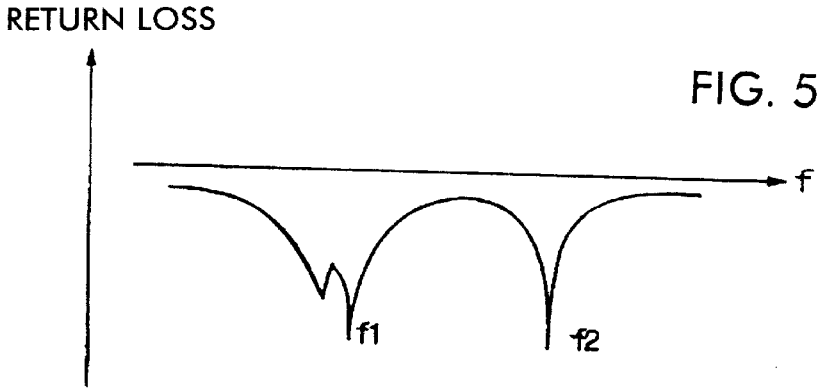

The meander pitch and the number of turns of the passive radiation electrode 12 are determined as follows. For example, among the bands at frequencies f1 and f2, the bandwidth of the band at frequency f1 is desired to be expanded. The meander pitch and the number of turns of the passive radiation electrode 12 are determined so that the resonant frequency of the passive radiation electrode 12 is a frequency f1' which slightly deviates from the resonant frequency f1 of the radiation electrode 3, as shown in FIG. 5A. When the passive radiation electrode 12 is formed to have such determined meander pitch and determined number of turns, the radiation electrode 3 has return-loss characteristics represented with a solid line in the band at frequency f1 in FIG. 5A. The passive radiation electrode 12 has return-loss characteristics represented with a dashed-line in FIG. 5A. Therefore, the combination of the radiation electrode 3 and the passive radiation electrode 12 causes dual resonance to occur in the band at frequency f1 as shown in FIG. 5B.

When the bandwidth of the band at frequency f2 is desired to be expanded, the meander pitch and the number of turns of the passive radiation electrode 12 are determined so that the resonant frequency of the passive radiation electrode 12 is a frequency f2' which slightly deviates from the resonant frequency f2 of the radiation electrode 3, as shown in FIG. 5A. When the passive radiation electrode 12 is formed to have such determined meander pitch and determined number of turns, the combination of the radiation electrode 3 and the passive radiation electrode 12 causes dual resonance to occur in the band at frequency f2.

As shown in FIG. 4, the feed electrode 5 is provided over the side surface 2*d* and the bottom face 2*f* of the dielectric substrate 2 so as to be in the proximity of the lead-in pattern 12*a*. In the same manner as in the first embodiment, the radiation electrode 3, in which the first electrode unit 3*a* and the second electrode unit 3*b* having different meander pitches are connected in series, is formed over the major surface 2*e* and the side surface 2*a*. The meandering pattern of the dielectric substrate 3 and the meandering pattern of the passive radiation electrode 12 are formed so as to maintain some distance therebetween and be generally perpendicular to each other. One end of the radiation electrode 3 is connected to the feed electrode 5, and the other end thereof is unconnected.

As shown in FIG. 4, the fixed electrodes 7*a* and 7*b* are formed on the side surface 2*b* of the dielectric substrate 2 so as to maintain some distance therebetween, and the fixed electrodes 7*c* and 7*d* are formed on the side surface 2*d*. The fixed electrodes 7*a*, 7*b*, 7*c* and 7*d* are each formed over the corresponding side surfaces and the bottom face 2*f*.

Figure 6:
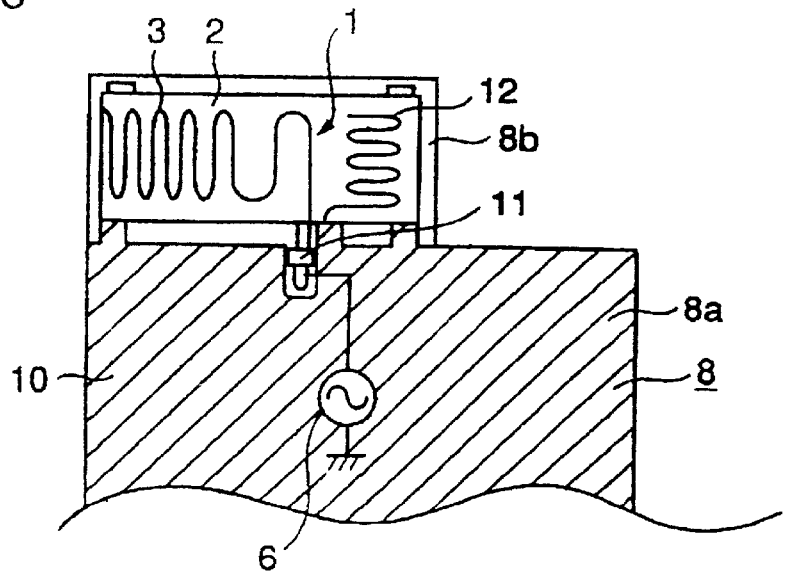
FIG. 6 is one implementation example of a circuit substrate provided with the surface-mount antenna according to the second embodiment.

The surface-mount antenna 1 according to the second embodiment is formed with the above-described construction. For example, as shown in FIG. 6, the surface-mount antenna 1 is implemented in the non-ground unit 8*b* of the circuit substrate 8 in the same manner as in the first embodiment. Such an implementation of the surface-mount antenna 1 in the circuit substrate 8 allows the radiation electrode 3 to be connected to the power supply 6 via the feed electrode 5 and the matching circuit 11. The fixed electrodes 7*a*, 7*b*, 7*c* and 7*d* and the lead-in pattern 12*a* are connected to the ground electrode 10 of the circuit substrate 8 thus being grounded.

When the power supply 6 supplies electrical power to the feed electrode 5 of the surface-mount antenna 1 via the matching circuit 11, the power is supplied from the feed electrode 5 to the radiation electrode 3 as well as, by means of electromagnetic coupling, to the lead-in pattern 12*a*. Since the supplied power drives the radiation electrode 3, the surface-mount antenna 1 can transmit and receive electromagnetic waves in the bands at frequencies f1 and f2. Furthermore, when the passive radiation electrode 12 is driven in accordance with the supplied power, dual resonance occurs in the band at frequency f1 or f2, which expands the bandwidth of the desired frequency band.

The passive radiation electrode 12 is provided on the surface of the dielectric substrate 2 so that the dual resonance occurs in one of the bands at frequencies f1 and f2, each of which allows the surface-mount antenna 1 to transmit and receive electromagnetic waves. Accordingly, the bandwidth of a desired frequency band among the bands at frequencies f1 and f2 can be expanded, which achieves broadening of the bandwidth of the antenna 1.

The meandering pattern of the radiation electrode 3 and that of the passive electrode 12 are formed so as to be substantially perpendicular to each other. Therefore, an interference problem in that the driving of the radiation electrode 3 adversely affects the driving of the passive radiation electrode 12 can be avoided. Because of this, the deterioration of antenna characteristics due to the above-described interference between the radiation electrode 3 and the passive radiation electrode 12 can be prevented.

A surface-mount antenna 1 according to a third embodiment of the present invention is described. Elements that are identical to corresponding elements in the foregoing embodiments have the same reference numerals, and a repeated description of identical elements is omitted.

Figure 7:
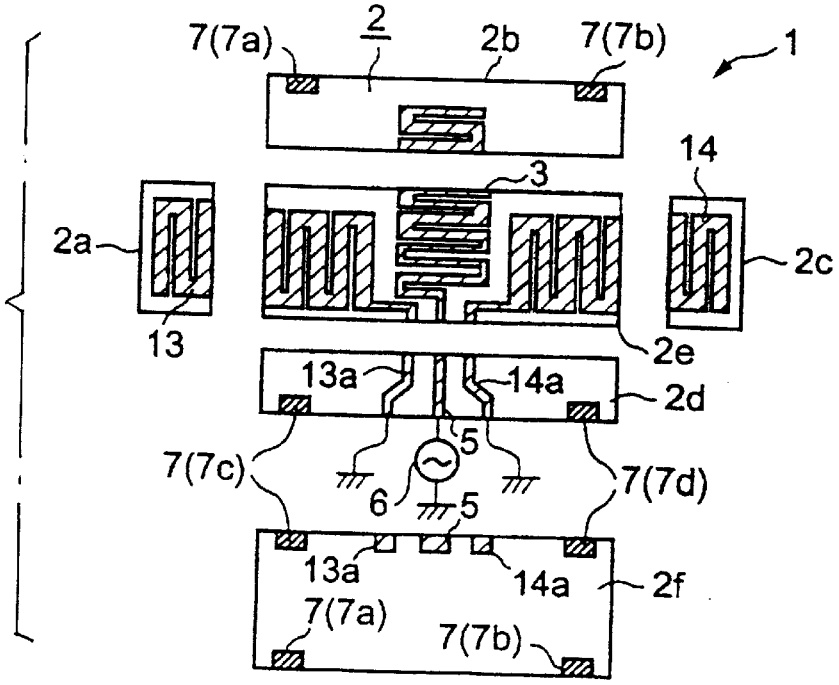
FIG. 7 is an illustration of a surface-mount antenna according to a third embodiment of the present invention.

FIG. 7 shows, in a expanded state, the surfaces of the dielectric substrate 2 which forms the surface-mount antenna 1 according to the third embodiment. A characteristic feature of the third embodiment is that a first passive radiation electrode 13 and a second passive radiation electrode 14 are formed as shown in FIG. 7.

In the third embodiment, the meandering radiation electrode 3 is formed over the major surface 2*e* and the side surface 2*b*, as shown in FIG. 7. The first passive radiation electrode 13 and the second passive radiation electrode 14 are formed so as to flank the radiation electrode 3. The first passive radiation electrode 13 is formed over the major surface 2*e* and the side surface 2*a* in the meandering pattern, and the second passive radiation electrode 14 is formed over the major surface 2*e* and the side surface 2*c* in the meandering pattern. These meandering patterns of the first passive radiation electrode 13 and the second passive radiation electrode 14 are substantially perpendicular to each other while maintaining some distance therebetween.

Figure 8A:
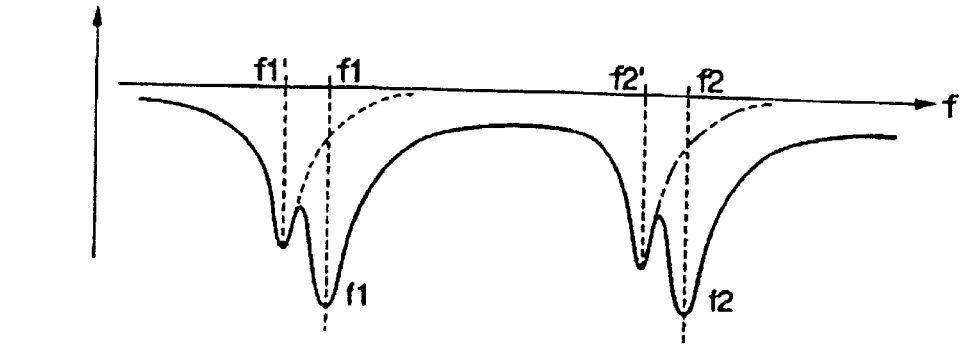
FIGS. 8A, 8B, and 8C are graphs illustrating examples of frequency bands in which the surface-mount antenna in FIG. 7 can transmit and receive electromagnetic waves.

The meander pitch and the number of turns of each of the first passive radiation electrode 13 and the second passive radiation electrode 14 are determined as follows. For example, when the surface-mount antenna 1 is required to transmit and receive electromagnetic waves in the two different bands at frequencies f1 and f2, the bandwidths of both bands at frequencies f1 and f2 are desired to be expanded. In this case, the meander pitch and the number of turns of one of the passive radiation electrode 13 and the second passive radiation electrode 14 are determined so that the resonant frequency f1' thereof slightly deviates from the resonant frequency f1 of the radiation electrode 3, as shown in FIG. 8. The meander pitch and the number of turns of the other passive radiation electrode are determined so that the resonant frequency f2' thereof slightly deviates from the resonant frequency f2 of the radiation electrode.

Figure 8B:
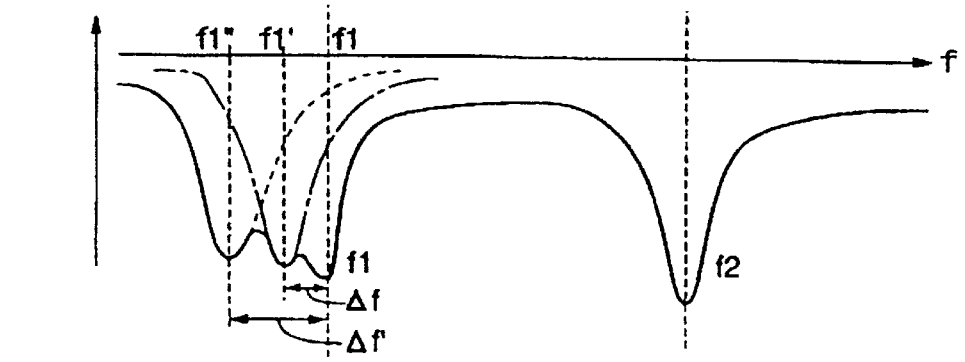

For example, the bandwidth of the band at frequency f1 among the bands at frequencies f1 and f2 is desired to be expanded. In this case, the meander pitch and the number of turns of one of the first passive radiation electrode 13 and the second passive radiation electrode 14 are determined so that, as shown in FIG. 8B, the resonant frequency f1' thereof deviates from the resonant frequency f1 of the radiation electrode 3 by a predetermined deviation Δf. The meander pitch and the number of turns of the other passive radiation electrode is determined so that the resonant frequency f1" thereof deviates from the resonant frequency f1 by the deviation Δf', which is not equal to the deviation Δf.

Figure 8C:
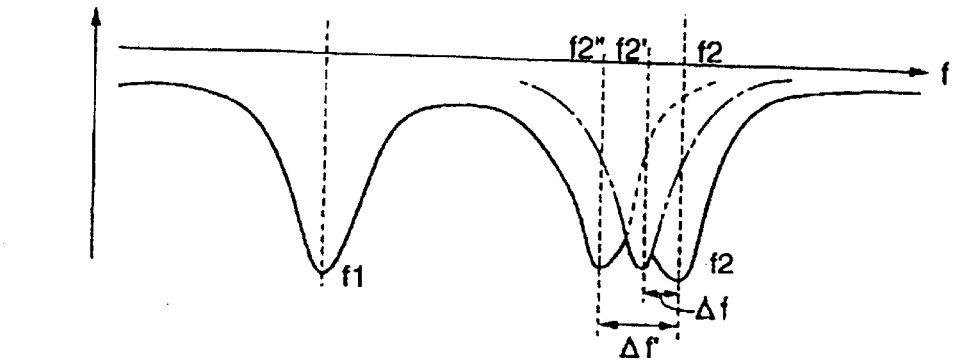

For example, the bandwidth of the band at frequency f2 is desired to be expanded. Likewise, as shown in FIG. 8C, the meander pitch and the number of turns of one of the first passive radiation electrode 13 and the second passive radiation electrode 14 are determined so that the resonant frequency f2' thereof deviates from the resonant frequency f2 of the radiation electrode 3 by a predetermined deviation Δf. The meander pitch and the number of turns of the other passive radiation electrode are determined so that the resonant frequency f2" thereof deviates from the resonant frequency f2 by a deviation Δf', which is not equal to the deviation Δf.

When the meander pitch and the number of turns of each of the first passive electrode 13 and the second passive electrode 14 are determined as described above, dual resonance can occur in a desired frequency band among the bands at frequencies f1 and f2. Accordingly, the bandwidth of the frequency band of the surface-mount antenna 1 can be expanded.

As shown in FIG. 7, the feed electrode 5 is formed over the side surface 2*d* and the bottom face 2*f*, and the fixed electrodes 7*a* and 7*b* are formed on the side surface 2*b* of the dielectric substrate 2 so as to maintain some distance therebetween. The fixed electrodes 7*c* and 7*d* are formed on the side surface 2*d*. In addition, lead-in patterns 13*a* and 14*a* are formed on the side surface 2*d* so as to be in the proximity of the feed electrode 5.

The fixed electrodes 7*a*, 7*b*, 7*c*, and 7*d* and the lead-in patterns 13*a* and 14*a* each cover parts of the bottom face 2*f* of the dielectric substrate 2.

Figure 9:
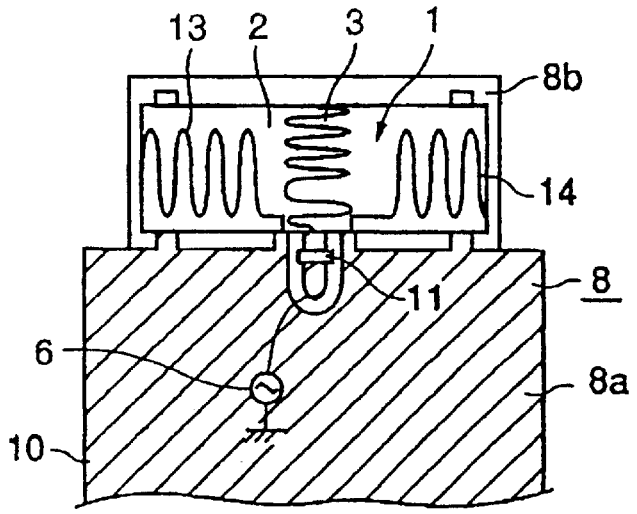
FIG. 9 is one implementation example of a circuit substrate provided with the surface-mount antenna according to the third embodiment.

The surface-mount antenna 1 is formed with the above-described construction and is implemented in the non-ground unit 8*b* of the circuit substrate 8 shown in FIG. 9. Thus, the implementation of the surface-mount antenna 1 allows the radiation electrode 3 to be connected to the power supply 6 via the feed electrode 5 and the matching circuit 11. The fixed electrodes 7*a*, 7*b*, 7*c*, and 7*d* and the lead-in patterns 13*a* and 14*a* are connected to the ground electrode 10 of the circuit substrate 8, thus being grounded.

The first passive radiation electrode 13 and the second passive radiation electrode 14 are constructed in which the dual resonance occurs in at least one of the two different bands at frequencies f1 and f2. This construction enables the bandwidth of the frequency band for the surface-mount antenna 1 to be expanded to a desired bandwidth, which cannot be obtained by driving only the radiation electrode 3. Therefore, broadening of the bandwidth for the surface-mount antenna 1 can be achieved.

The meandering pattern of the radiation electrode 3 and the meandering pattern of each of the first passive radiation electrode 13 and the second passive radiation electrode 14 are formed so as to be substantially perpendicular to each other. Furthermore, since the unconnected end of each of the first passive electrode 13 and the second passive electrode 14 is formed on the corresponding side surface of the dielectric substrate 2, capacitive coupling between these passive electrodes and the ground is enhanced. Accordingly, the interference problem in that the driving of the radiation electrode 3 adversely affects the driving of the first passive radiation electrode 13 and that of the second passive radiation electrode 14 can be more positively avoided, whereby the desired dual resonance can be obtained. Therefore, the deterioration of antenna characteristics due to the interference among the radiation electrode 3, the first passive radiation electrode 13, and the second passive radiation electrode 14 can be prevented.

A surface-mount antenna 1 according to a fourth embodiment is described. A characteristic feature of the fourth embodiment is that the matching circuit 11 is formed on the surface of the dielectric substrate 2. Otherwise, the construction thereof is identical to those according to the foregoing embodiments. Elements that are identical to corresponding elements in the first embodiment have the same reference numerals, and a repeated description of identical elements is omitted.

Figure 10A:
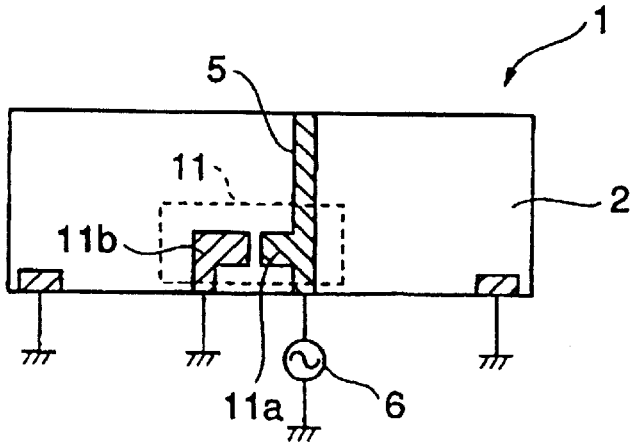
FIGS. 10A and 10B are illustrations of one example of a matching circuit in a surface-mount antenna according to a fourth embodiment in which matching is performed using a capacitor.
Figure 11A:
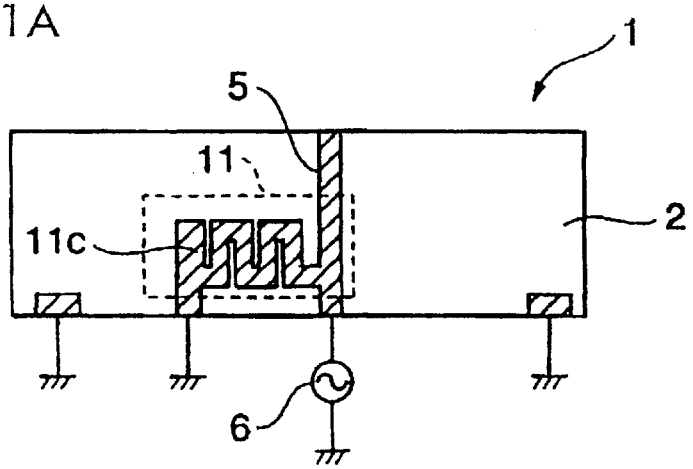
FIGS. 11A and 11B are illustrations of one example of a matching circuit of a surface-mount antenna according to the fourth embodiment in which matching is performed using an inductor.

In the fourth embodiment, as shown in FIGS. 10A and 11A, the matching circuit 11 is formed on the surface of the dielectric substrate 2 and is connected to the feed electrode 5.

Figure 10B:
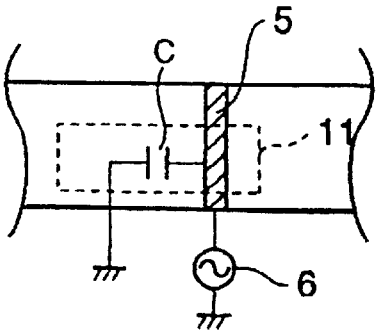

FIG. 10B shows an equivalent circuit of the matching circuit 11 in FIG. 10A. Matching is obtained in the matching circuit 11 with the use of a capacitor C in FIG. 10B. As shown in FIG. 10A, the matching circuit 11 has the capacitor C including a conductive pattern 11*a* that is connected with the feed electrode 5 and a conductive pattern 11*b* that faces the conductive pattern 11*a* while some distance is maintained therebetween.

Figure 11B:
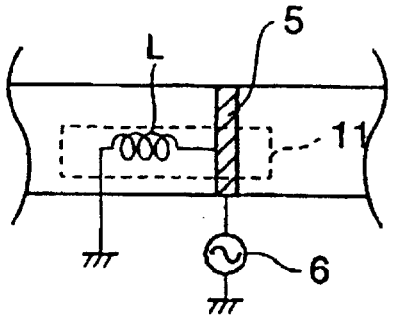

FIG. 11B shows an equivalent circuit of the matching circuit 11 shown in FIG. 11A. Matching is obtained in the matching circuit 11 with the use of an inductor L as shown in FIG. 11B. As shown in FIG. 11A, the matching circuit 11 has the inductor L including a meandering conductive pattern 11*c*.

The provision of the matching circuit 11 in the dielectric substrate 2 enables substantially the same advantages as obtained in the foregoing embodiments to be achieved. Furthermore, since there is no need to provide the matching circuit 11 in the circuit substrate 8, the size of the circuit substrate 8 can be reduced.

The matching circuit 11 includes the conductive patterns 11*a* and 11*b*, or the conductive pattern 11*c*. Accordingly, by simply forming the conductive patterns 11*a* and 11*b* or the conductive pattern 11*c* on the surface of the dielectric substrate 2 by printing or the like, the matching circuit 11 can be easily formed. Because of this, the number of required parts of the matching circuit 11 is decreased, which reduces the manufacturing cost.

A communication apparatus according to a fifth embodiment of the present invention is described. A characteristic feature of the fifth embodiment is that the communication apparatus has the surface-mount antenna 1 shown in one of the foregoing embodiments incorporated therein. Elements that are identical to corresponding elements in the foregoing embodiments have the same reference numerals, and a repeated description of identical elements is omitted.

Figure 15:
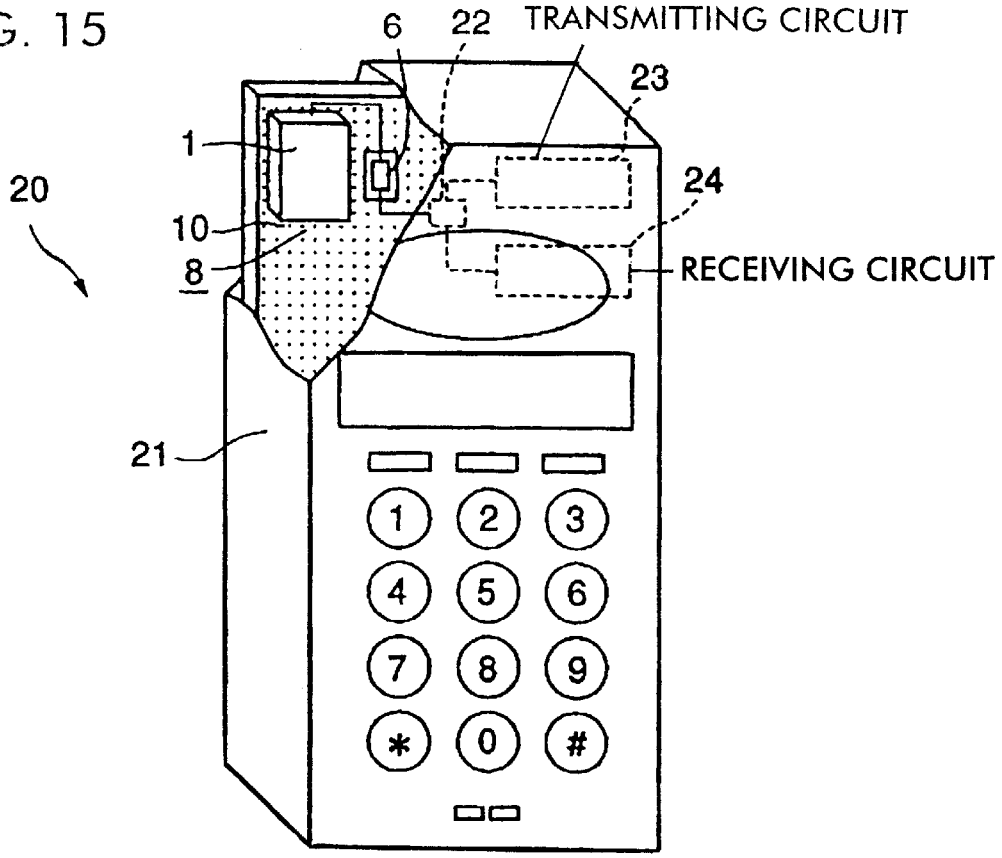
FIG. 15 is an illustration of one example of a communication apparatus provided with the surface-mount antenna.
Figure 16:
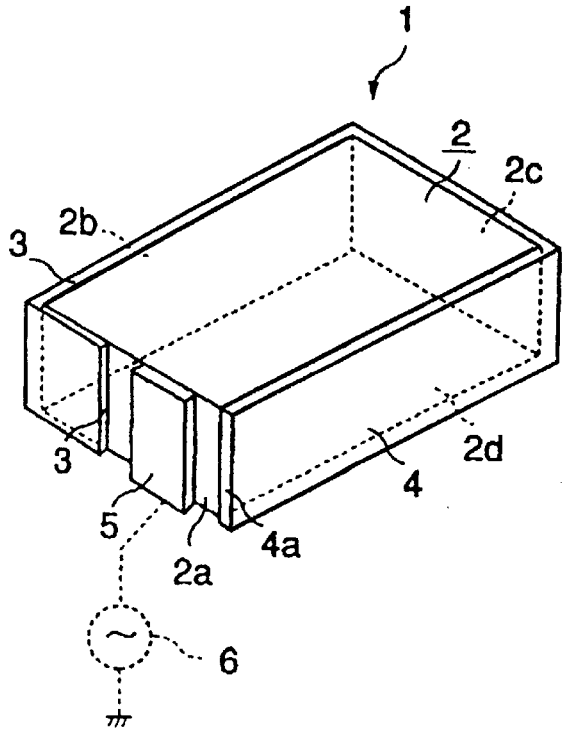
FIG. 16 is an illustration of a conventional surface-mount antenna.

FIG. 15 shows one example of a portable telephone 20, which is a typical communication apparatus according to the fifth embodiment. As shown in FIG. 15, the portable telephone 20 has a casing 21 that is provided with the circuit substrate 8. The circuit substrate 8 includes the power supply 6, the ground electrode 10, and the surface-mount antenna 1 provided on the ground electrode 10. The power supply 6 is connected to a transmission circuit 23 and a reception circuit 24 via a switching circuit 22.

In the communication apparatus 20, electrical power is supplied from the power supply 6 to the surface-mount antenna 1 in which the above-described antenna actions are performed. The transmission or the reception of signals is smoothly switched in accordance with actions of the switching circuit 22.

According to the fifth embodiment, since the portable telephone 20 is provided with the surface-mount antenna 1, electromagnetic waves in the two different frequency bands can be transmitted or received with the single antenna. Accordingly, the communication apparatus (here, the portable telephone) 20 can be miniaturized.

The present invention is not limited to the foregoing embodiments and may take various other forms of embodiments. For example, though the dielectric substrates 2 is a rectangular parallelepiped in the foregoing embodiments, it may be columnar.

Figure 12:
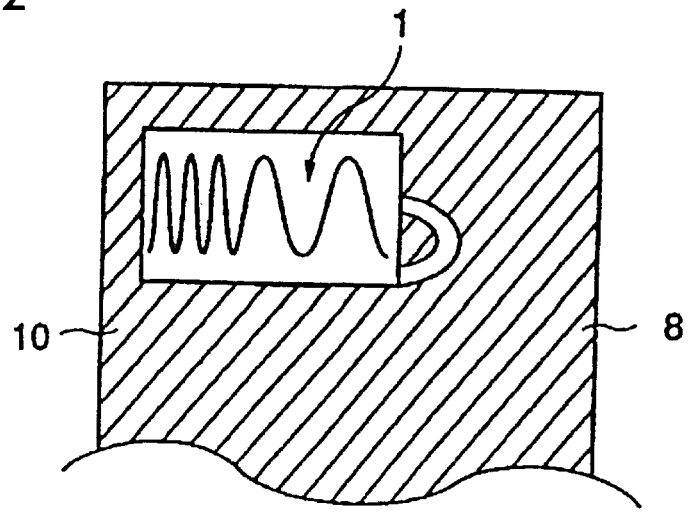
FIG. 12 is an illustration of one implementation example of a ground electrode of the circuit substrate provided with the surface-mount antenna.

According to the first to the fourth embodiments, the surface-mount antenna 1 is implemented in the non-ground unit 8*b* of the circuit substrate 8. The present invention may be applied to the surface-mount antenna 1 that is implemented on the ground electrode 10 of the circuit substrate 8 as shown in FIG. 12.

Figure 13A:
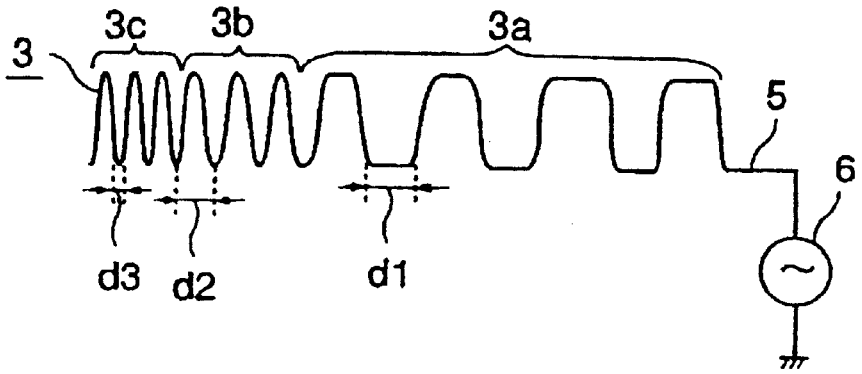
FIGS. 13A and 13B are illustrations of another embodiment.
Figure 13B:
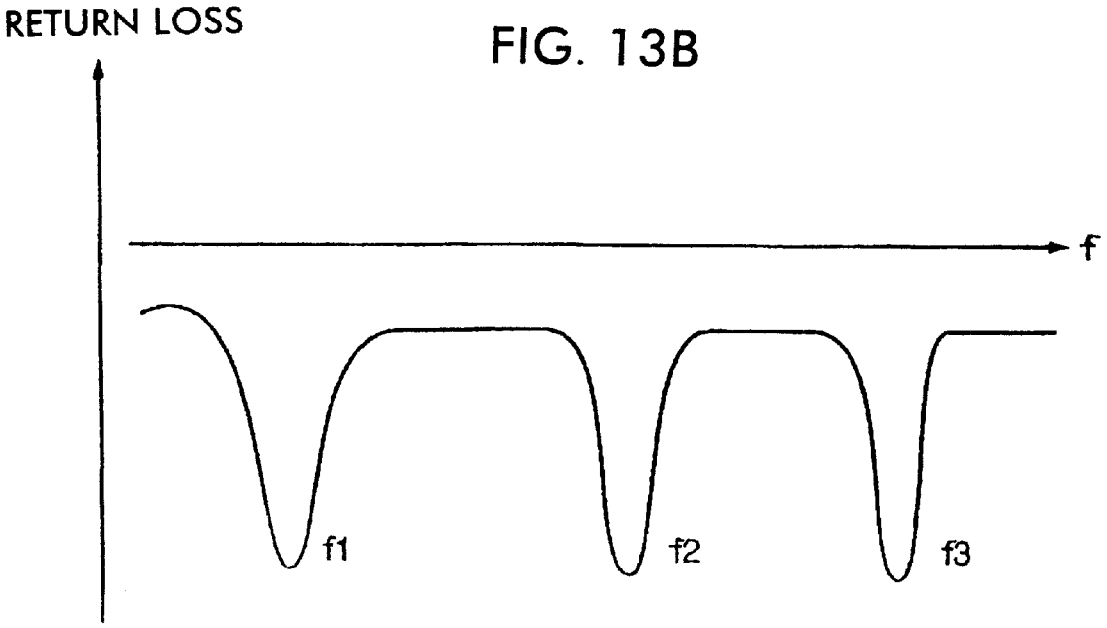

In the foregoing embodiments, the radiation electrode 3 is constructed in which the two electrode units 3*a* and 3*b* that have different meander pitches are connected in series. However, the radiation electrode 3 may be constructed to have more than two electrode units having different meander pitches connected in series. For example, the radiation electrode 3 shown in FIG. 13A is constructed in which three electrode units 3*a*, 3*b*, and 3*c* that have different meander pitches d1, d2, and d3, respectively, are connected in series. In this case, because of the radiation electrode 3, the return-loss of the surface-mount antenna 1 is reduced in each of three different bands at frequencies f1, f2 and f3, as shown in FIG. 13B, in which electromagnetic waves can be transmitted and received.

Figure 14A:
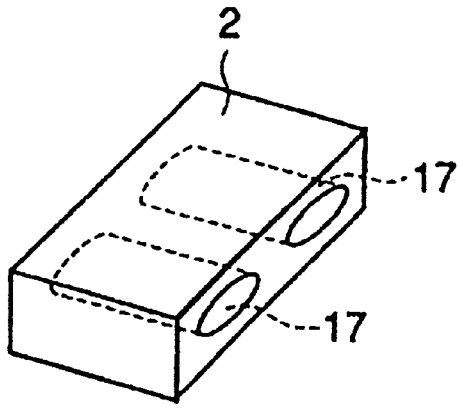
FIGS. 14A, 14B, and 14C are illustrations of further embodiments.
Figure 14B:
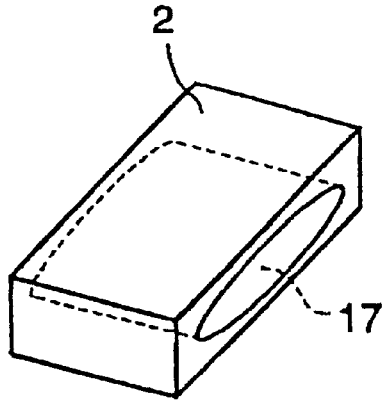
Figure 14C:
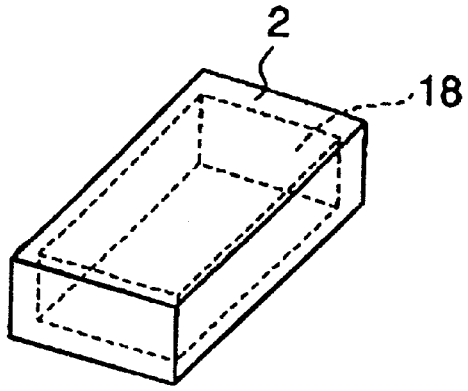

A hole part 17 or a cavity part 18 may be provided in the dielectric substrate 2, as shown in FIGS. 14A, 14B, and 14C. Such provision of the hole part 17 or the cavity part 18 leads to a lightweight dielectric substrate 2. Furthermore, since the dielectric constant between the ground and the radiation electrode 3 is decreased and the intensification of the electric field is lessened, the surface-mount antenna 1 having a broad frequency band and a high gain can be obtained.

In the foregoing embodiments, the radiation electrode 3 is formed over more than one face of the dielectric substrate 2. The radiation electrode 3 may be formed so as to be confined within a single face of the dielectric substrate 2 when the meander pitch, the number of turns, and the like of each of the first electrode unit 3*a* and the second electrode unit 3*b* allow.

In the fifth embodiment, the portable telephone 20 is provided with the surface-mount antenna 1. The surface-mount antenna 1 according to the present invention may be provided in a communication apparatus other than the portable telephone 20. As described above, miniaturization of the communication apparatus can be achieved.

While the invention has been particularly shown and described with reference to preferred embodiments thereof, it will be understood by those skilled in the art that the forgoing and other changes in form and details may be made therein without departing from the spirit of the invention.

What is claimed is:

1. A surface-mount antenna, comprising:

a dielectric substrate in a rectangular parallelepiped shape and including a first major surface, a second major surface, a first side surface, a second side surface, a first end surface and a second end surface;

a radiation electrode having a meandering pattern disposed on at least two surfaces among the first major surface, the first side surface and the second side surface of the dielectric substrate and comprising at least a first meandering electrode unit and a second meandering electrode unit being connected in series; and the first meandering electrode unit having first meander pitches and the second meandering electrode unit having second meander pitches which are narrower than the first pitches;

whereby the radiation electrode is allowed to transmit and receive electromagnetic waves in at least two different frequency bands.

2. The surface-mount antenna according to claim 1, further comprising at least one passive radiation electrode disposed on the surface of said dielectric substrate and electromagnetically coupled with the radiation electrode, whereby the at least one passive radiation electrode causes dual resonance to occur in at least one frequency band among said at least two different frequency bands of the surface-mount antenna.

3. The surface-mount antenna according to claim 2, wherein the at least one passive radiation electrode has a meandering pattern.

4. The surface-mount antenna according to claim 2, wherein the at least one passive radiation electrode is disposed on at least two faces among the first major surface, the first side surface and the second side surface of the dielectric substrate.

5. The surface-mount antenna according to claim 3, wherein:

the at least one passive radiation electrode is disposed on at least the first major surface of the dielectric substrate, the disposed position thereof being different from the disposed position of the radiation electrode; and the meandering pattern of the at least one passive radiation electrode is substantially perpendicular to that of the radiation electrode.

6. The surface-mount antenna according to claim 1, further comprising a matching circuit in association with the dielectric substrate, and the radiation electrode is coupled with a power supply via the matching circuit.

7. A communication apparatus comprising at least one of a transmitter and a receiver, and further comprising a surface-mount antenna mounted on a circuit substrate, the surface-mount antenna comprising:

a dielectric substrate in a rectangular parallelepiped shape and including a first major surface, a second major surface, a first side surface, a second side surface, a first end surface and a second end surface;

a radiation electrode having a meandering pattern disposed on at least two surfaces among the first major surface, the first side surface and the second side surface of the dielectric substrate and comprising at least a first meandering electrode unit and a second meandering electrode unit being connected in series; and the first meandering electrode unit having first meander pitches and the second meandering electrode unit having second meander pitches which are narrower than the first pitches;

whereby the radiation electrode is allowed to transmit and receive electromagnetic waves in at least two different frequency bands.

* * * * *